United States Patent [19]

Sindelar

[11] 4,055,913

[45] Nov. 1, 1977

[54] MECHANICAL TOY

[76] Inventor: John B. Sindelar, Box 30, Loyalton, S. Dak. 57459

[21] Appl. No.: 694,547

[22] Filed: Aug. 5, 1976

[51] Int. Cl.[2] ..... A63H 29/08

[52] U.S. Cl. ..... 46/143; 46/162

[58] Field of Search ..... 46/43, 116, 162

[56] References Cited

U.S. PATENT DOCUMENTS

| | | | |
|---|---|---|---|
| 1,388,059 | 8/1921 | Richman | 46/43 |
| 1,687,315 | 10/1928 | Roche | 46/43 |
| 3,949,516 | 4/1976 | Gronert | 46/43 |

*Primary Examiner*—Russell R. Kinsey

*Assistant Examiner*—Robert F. Cutting

[57] ABSTRACT

This toy consists primarily of a take-apart structure having a base supporting posts which removably receive a slanted and open-ended container in which balls are placed. The structure includes a pivotable device for releasing one ball at a time when it is momentarily contacted by an open-ended cup portion of a pivotable rod secured to the post, the rod including lever means for automatically releasing a ball from the cup portion when it is in its down position and return of the cup portion to the upward position is accomplished by the weight of an attached animated figure, through gravity means.

2 Claims, 2 Drawing Figures

MECHANICAL TOY

This invention relates to toys, and more particularly to a mechanical toy.

It is therefore the principal object of this invention to provide a mechanical toy which will have an angled container with balls therein that will be releasable by a weighted end of rod means, the weighted end being an animated and pivotable figure pivotably attached to lever means to release the ball from the cup portion of the pivotable rod means.

Another object of this invention is to provide a mechanical toy of the type described, which will have on the container, at one end, a pivotable ball-retaining member which will be pivotable upwards by the contact of the cup portion of the pivotable rod so as to release a single ball at a time, into the cup portion.

A further object of this invention is to provide a device of the type described by which the weight of the ball within the cup portion, will cause the pivotable rod to which the animated figure is attached, to descend, whereupon by lever means, one end of the lever means will slide from beneath the ball, thus releasing it from the downward position within a slanted opening of the base whereupon the ball will roll away and the action will be continuous as long as balls remain within the slanted container of the device.

Other objects of the invention are to provide a mechanical toy which is simple in design, inexpensive to manufacture, rugged in construction, easy to use and efficient in operation.

These and other objects will be readily evident upon a study of the following specification and the accompanying drawing, wherein.

Figure 1:
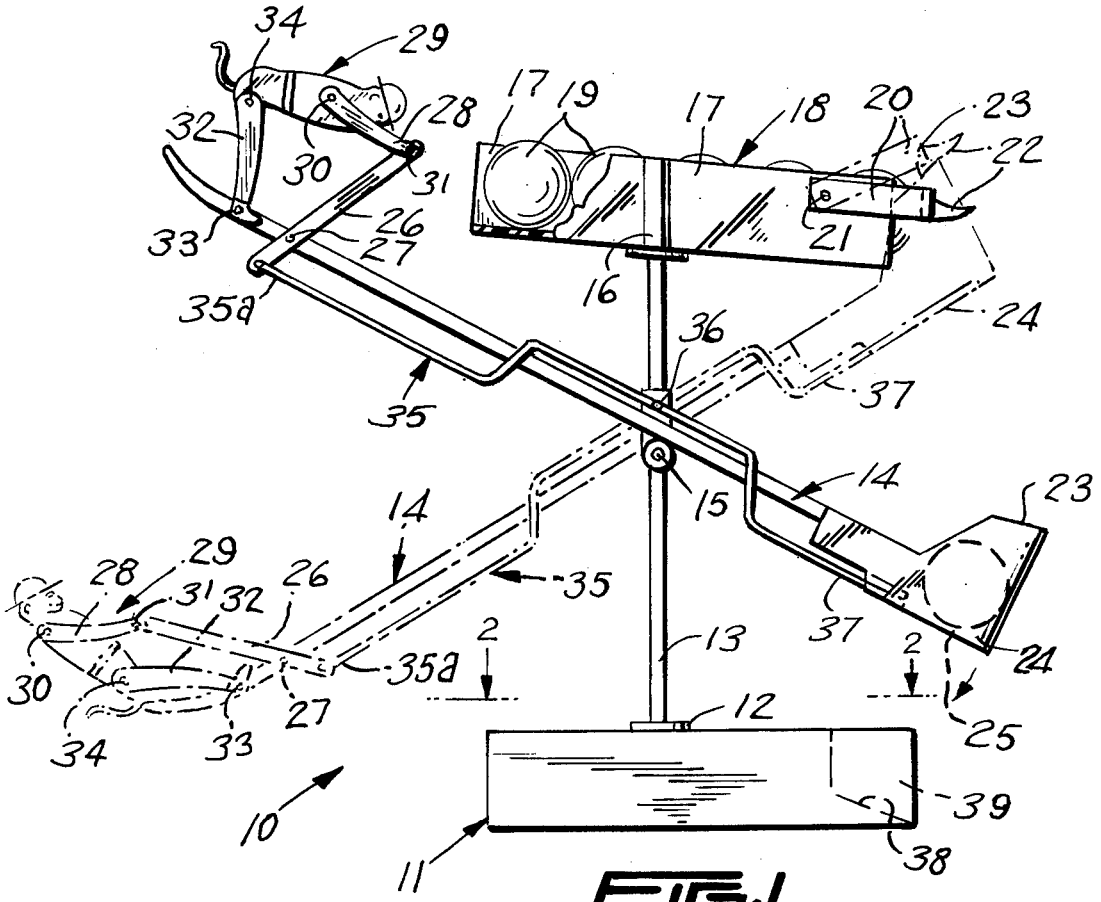
FIG. 1 is a side view of the present invention shown in elevation, partly broken away, with the ball receiving cup portion shown in phantom lines in its uppermost position.
Figure 2:
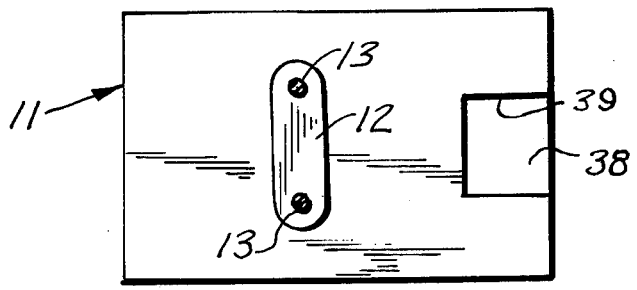
FIG. 2 is a cross sectional view taken along the line 2—2 of FIG. 1.

According to this invention, a toy 10 is shown to include a rectangular, configurated base 11. A plate 12 is secured fixedly in a suitable manner to a pair of parallel posts 13 is positioned upon the top of base 11, the posts 13 having their lower ends removably received within openings (not shown) in the top of base 11. An elongated rod 14 is supported by resting upon a roller 15*a* mounted rotatably free on a pivot pin 15 supported between the posts. The upper extremities of posts 13 are one each, removably received within sleeve portions 16 integral of the side walls 17 of container 18. Container 18 is angularly positioned with respect to base 11 and freely receives a plurality of balls 19.

Balls 19 are retained within the open ended container 18, by means of a "U" shaped member 20 which is pivotably secured to side walls 17 by means of pins 21. An accurate projection 22 of member 20 is integral therewith and is pivoted upwards when contact is made with the edge 23 of the cup portion 24 of rod 14. When the aforementioned occurs, one ball 19 by gravity means, will descend into the cup portion 24, whereupon rod 14 will descend pivotably downwards by the weight of the ball 19 therein.

It shall be noted that the opening 25 within the cup portion 24 of rod 14 is sealed off in a manner which hereinafter will be described so as to enable the ball 19 to remain until the full movement of rod 14 is achieved.

A lever 26 is secured by pins 27 to rod 14 and the arms 28 of monkey 29 are secured to monkey 29 by pin 30, the forward hand portions of the arms 28 being secured by pin 31 to the outer end of lever 26. The leg portions 32 of monkey 29 are secured to rod 14 by means of pin 33 and the opposite ends of leg 32 are secured by pin 34 to monkey 29. A lever rods 35 is secured pivotably at one end 35*a* to the lower portion of lever 26 and lever rod 35 is pivotable by means of pin 36 of posts 13 and the opposite ends 37 of lever rod 35 slides away from opening 25 of cup portion 24, thus releasing the ball 19 therein whereupon it falls upon the slanted surface 38 within opening 39. It will be noted that while the lever rod 35 pivots about the pin 36, the movement of the monkey figure about pivot pin 33 (due to gravity force) and the resultant movement of the lever 26, will cause the rod 14 to slide upon the roller 152 along the axis of rod 14 so that the rod end 27 is thus moved out of the cup 24, so to be out of the way, and allow the ball to drop out of an opening in the bottom of the cup.

What I now claim is:

1. A mechanical toy, comprising a base for support on a stationary surface, a pair of vertically upright posts supported on said base, a horizontally inclined container upon an upper end of said posts, said container holding a plurality of balls, an opening in a downwardly inclined end of said container for rolling of said balls out of said container, a U-shaped retainer pivoted around said end opening, normally preventing said balls to roll outward; a rod pivoted at its intermediate portion over a roller pivoted on a pivot pin between an intermediate portion of said posts, one end of said rod having a cup, an upper edge of said cup pivoting said U-shaped retainer upwardly when said rod end is upwardly pivoted, so to release one said ball from said container into said cup, said cup containing said ball being heavier than an opposite end of said rod, so to cause said cup to downwardly pivot about said roller, an underside of said cup abutting with a sloping chute of said base, when said rod cup is downwardly pivoted, and means for transferring said ball from said cup to said chute, when said cup abuts said chute.

2. The combination as set forth in claim 1, wherein said means comprises a slidable door on a bottom of said cup, said door being affixed to one end of a lever rod extending parallel to said rod, said lever rod being pivotable about a second pivot pin between said posts and located spaced above said roller and rod, an opposite end of said lever rod being pivotally attached to a lower end of a lever, which along an intermediate portion thereof is pivotally attached near an opposite end of said rod, a terminal tip of said opposite end supporting a monkey figurine by feet thereof being pivotally attached to said terminal tip, said feet being integral with a pair of legs pivotally attached on each side of a body of said figurine, a pair of arms on each side of said body being pivoted at their one end to said body and being pivotally attached at their outward ends to an upper end of said lever; said figurine facing toward a center of said rod, and being forwardly pivoted by gravity force about a pivot pin through said feet and through said rod opposite end when said rod opposite end is in an upwardly raised position, said forwardly pivoted figurine causing said rod to be axially slid upon said roller so that said cup is slid off said door, and an opening in a bottom of said cup thus allows said ball to fall outwardly therethrough.

* * * * *